US007478878B2

(12) United States Patent
Oettinger

(10) Patent No.: US 7,478,878 B2
(45) Date of Patent: Jan. 20, 2009

(54) MULTI-DIRECTIONAL, SELF-RIGHTING CHAIR

(76) Inventor: Marc P. Oettinger, 941 Calle Mejia #105, Santa Fe, NM (US) 87501

( * ) Notice: Subject to any disclaimer, the term of this patent is extended or adjusted under 35 U.S.C. 154(b) by 0 days.

(21) Appl. No.: 11/562,312

(22) Filed: Nov. 21, 2006

(65) Prior Publication Data

US 2007/0138850 A1 Jun. 21, 2007

Related U.S. Application Data

(60) Provisional application No. 60/738,607, filed on Nov. 22, 2005.

(51) Int. Cl.
*A47C 3/02* (2006.01)

(52) U.S. Cl. ..... 297/271

(58) Field of Classification Search ..... 297/271.5, 297/258.1, 272.1, 461, 313, 181, 344.21, 297/259.1; D6/348, 344; 472/102, 101, 472/135

See application file for complete search history.

(56) References Cited

U.S. PATENT DOCUMENTS

| | | | | |
|---|---|---|---|---|
| 1,730,309 | A | 10/1929 | Tubbs | |
| D153,191 | S | 3/1949 | Walters | |
| 2,764,859 | A | 10/1956 | Hanselmann | |
| 3,307,319 | A | 3/1967 | Christensen et al. | |
| 3,312,437 | A * | 4/1967 | Barth | 248/158 |
| 3,458,966 | A | 8/1969 | Dunbar et al. | |
| 3,699,913 | A * | 10/1972 | Sautbine | 116/63 P |
| 3,899,210 | A | 8/1975 | Samhammer et al. | |
| 3,935,690 | A | 2/1976 | Lea et al. | |
| 3,965,506 | A | 6/1976 | Marks | |
| 3,968,620 | A | 7/1976 | Keltner | |
| 3,992,733 | A | 11/1976 | Racine | |
| 4,011,611 | A | 3/1977 | Lederman | |
| 4,016,707 | A | 4/1977 | Puchosic | |
| 4,027,888 | A | 6/1977 | Wilcox | |
| 4,084,273 | A * | 4/1978 | Haynes | 5/105 |
| 4,184,237 | A | 1/1980 | Blankenship | |
| 4,327,046 | A | 4/1982 | Davis et al. | |

(Continued)

FOREIGN PATENT DOCUMENTS

DE 4221104 A1 1/1993

(Continued)

OTHER PUBLICATIONS

Provisional Patent Application entitled Multi-Directional Self-Righting Seat, U.S. Appl. No. 60/738,607, filed Nov. 22, 2005 (10 pages).

(Continued)

*Primary Examiner*—Milton Nelson, Jr.
(74) *Attorney, Agent, or Firm*—Workman Nydegger

(57) ABSTRACT

A self-righting chair of the present invention includes: (i) a seat; (ii) a base member; and (iii) a connector connecting the base member to the seat, wherein the base member has a curved configuration, and wherein the base member has sufficient weight, such that when a force is exerted to move the chair from a substantially vertical position to a tilted position, the chair is moved from the substantially vertical position to the tilted position, then returns to the substantially vertical position when the tilting force is removed.

24 Claims, 10 Drawing Sheets

U.S. PATENT DOCUMENTS

| | | | | | |
|---|---|---|---|---|---|
| D265,218 | S | * | 6/1982 | Robinett | D21/412 |
| 4,418,514 | A | | 12/1983 | Spann | |
| 4,645,081 | A | * | 2/1987 | Korth | 211/196 |
| 4,841,713 | A | | 6/1989 | Beier | |
| 4,928,337 | A | | 5/1990 | Chauncey | |
| 5,106,884 | A | | 4/1992 | Turner et al. | |
| 5,112,103 | A | | 5/1992 | Downer | |
| 5,190,504 | A | | 3/1993 | Scatterday | |
| 5,228,158 | A | | 7/1993 | Park | |
| 5,242,348 | A | | 9/1993 | Bates | |
| 5,265,295 | A | | 11/1993 | Sturgis | |
| 5,350,342 | A | | 9/1994 | Scatterday | |
| D355,077 | S | | 2/1995 | Tegner | |
| 5,413,332 | A | | 5/1995 | Montgomery | |
| 5,433,438 | A | | 7/1995 | Gilman | |
| 5,476,184 | A | | 12/1995 | Hill | |
| 5,496,026 | A | | 3/1996 | Montgomery | |
| 5,566,953 | A | | 10/1996 | Arriola et al. | |
| 5,620,069 | A | | 4/1997 | Hurwitz | |
| D384,211 | S | | 9/1997 | Wied et al. | |
| 5,718,655 | A | | 2/1998 | Phillips | |
| 5,733,012 | A | | 3/1998 | Jones | |
| 5,755,648 | A | | 5/1998 | Kildani | |
| 5,772,543 | A | | 6/1998 | Paino | |
| 5,813,932 | A | | 9/1998 | Grafton | |
| 5,839,992 | A | | 11/1998 | Phillips | |
| 5,863,278 | A | | 1/1999 | Chen | |
| 5,878,551 | A | | 3/1999 | Curley et al. | |
| 5,891,000 | A | | 4/1999 | Phillips | |
| 5,909,925 | A | | 6/1999 | Glockl | |
| 5,921,628 | A | | 7/1999 | Glockl | |
| 6,053,829 | A | | 4/2000 | Conley | |
| 6,141,807 | A | | 11/2000 | Tapper | |
| 6,149,555 | A | | 11/2000 | Kinback | |
| 6,186,662 | B1 | | 2/2001 | Jackson | |
| 6,241,637 | B1 | | 6/2001 | Basyuk | |
| 6,279,184 | B1 | | 8/2001 | George, II | |
| 6,328,675 | B1 | | 12/2001 | Kaye | |
| 6,334,227 | B1 | | 1/2002 | Larger | |
| 6,363,557 | B2 | | 4/2002 | Chou | |
| 6,386,635 | B1 | | 5/2002 | Ralph | |
| 6,387,022 | B1 | | 5/2002 | Smith | |
| 6,532,613 | B2 | | 3/2003 | Berry, IV | |
| 6,547,706 | B1 | | 4/2003 | Chek | |
| 6,652,421 | B1 | | 11/2003 | Chen | |
| 6,725,482 | B2 | | 4/2004 | George, II | |
| 6,732,391 | B2 | | 5/2004 | George, II | |
| 6,746,372 | B2 | | 6/2004 | Hsu | |
| 6,834,916 | B2 | | 12/2004 | Volkman et al. | |
| 6,837,835 | B2 | | 1/2005 | Huang | |
| 6,837,836 | B2 | | 1/2005 | Huang | |
| 6,952,906 | B2 | | 10/2005 | Nelson | |
| 7,156,790 | B2 | * | 1/2007 | Johnsen | 482/146 |
| 2003/0060346 | A1 | | 3/2003 | Wu | |
| 2003/0066268 | A1 | | 4/2003 | George, II | |
| 2003/0148860 | A1 | | 8/2003 | Wren | |
| 2003/0151295 | A1 | | 8/2003 | Nelson | |
| 2003/0164633 | A1 | * | 9/2003 | Jakus et al. | 297/271.5 |
| 2004/0110611 | A1 | | 6/2004 | Huang | |
| 2004/0110613 | A1 | | 6/2004 | Huang | |
| 2005/0107229 | A1 | | 5/2005 | Wickens | |
| 2005/0143234 | A1 | | 6/2005 | Massey | |
| 2006/0063653 | A1 | | 3/2006 | Wickens et al. | |

FOREIGN PATENT DOCUMENTS

| | | | | |
|---|---|---|---|---|
| EP | 0705760 | A1 | | 4/1996 |
| EP | 0705760 | B1 | | 3/1999 |
| GB | 2214071 | A | | 8/1989 |
| GB | 2244434 | A | * | 12/1991 |
| WO | WO 1987/002643 | | | 5/1987 |

OTHER PUBLICATIONS

Photographs (2 pages) of tennis ball partially filled with sand, and available, on information and belief, at juggling promotion prior to Oct. 2002 and discussed in "Remarks, p. 11 of 14, Response to Office Action dated Jun. 19, 2007, U.S. Appl. No. 11/182,174."

Photographs (2 pages) of tennis ball partially filled with sand and available, on information and belief, at juggling promotion prior to Oct. 2002.

PCT International Search Report (2 pages), international application No. PCT/US06/27481, mailed Mar. 1, 2007.

PCT Written Opinion of the International Search Authority (5 pages), international application No. PCT/US06/27481, mailed Mar. 1, 2007.

Photographs (2 pages) of tennis ball partially filled with sand, and available, on information and belief, at juggling promotion prior to Oct. 2002 and discussed in Remarks, p. 11 of 14, Response to Office Action dated Jun. 19, 2007, U.S. Appl. No. 11/182,174, Publication No. 2006/0063653 A1 to Wickens et al.

PCT Written Opinion of the International Searching Authority (5 pages), international application No. PCT/US06/27481, mailed Mar. 1, 2007.

Remarks, p. 11 of 14, Response to Office Action dated Jun. 19, 2007, U.S. Appl. No. 11/182,174.

* cited by examiner

MULTI-DIRECTIONAL, SELF-RIGHTING CHAIR

CROSS-REFERENCE TO RELATED APPLICATIONS

This application claims priority to and the benefit of U.S. provisional patent application No. 60/738,607 filed Nov. 22, 2005 entitled "Multi-Directional Self-Righting Seat" to Marc Oettinger, which is incorporated herein in its entirety by reference.

BACKGROUND OF THE INVENTION

1. The Field of the Invention

The disclosed invention is in the field of furniture and is specifically in the field of chairs designed to promote healthy lifestyle sitting.

2. Background

The U.S. Department of Labor reported 1.4 million work-related injuries and illnesses in 2002. Sprains and strains accounted for 43% of these injuries. It is assumed that many of these injuries could be attributable to immobile or improper body posture, especially for individuals seated in front of computer screens or at desks for extended periods of time. Stiff spines, sore necks, shoulders, carpal tunnel syndrome, and leg cramping are common injuries resulting from poor seating options and choices, leading to overall lowered worker productivity.

Moreover, these conditions can lead to more adverse health effects requiring costly medical attention and treatment such as medication, physical therapy, and/or chiropractic therapy. Unfortunately, it is the company and the overall economy that both assumes and realizes the expense risks related to not using appropriate seating equipment. A simple seating solution designed to alleviate such stress and strain while the seated individual is performing normal daily tasks, such as in the workplace or home office, would be a beneficial and worthy preventative investment.

BRIEF SUMMARY OF THE INVENTION

A self-righting chair of the present invention comprises: (i) a seat; (ii) a base member; and (iii) a connector connecting the seat to the base member, wherein the base member has a curved configuration, and wherein the base member has sufficient weight, such that when a force is exerted to move the chair from a substantially vertical position to a tilted position, the chair is moved from the substantially vertical position to the tilted position, then returns to the substantially vertical position when the tilting force is removed.

In one embodiment of the present invention, the chair comprises a substantially semi-spherical base member having a substantially uniform distribution of mass throughout the base member. The bottom surface of the semi-spherical base member has a curvature such that the chair can be rocked back and forth, side to side, or in a variety of different directions, thereby enabling the user to rock while sitting in the chair in a practically endless number of different directions.

Since the base member is heavier than the combined weight of the connector and the seat, the chair also self-rights itself, thereby causing the chair to be in a neutral, substantially vertical position whenever the user desires to sit on the chair. Thus, the chair is ready for convenient seating even if the chair were in a tilted position when the user moved off the chair. For example, in one embodiment, at least about sixty percent (60%) of the weight of the overall chair is attributable to the base member. In one embodiment, the base member encapsulates a lower portion of the connector. In another embodiment, the base member extends integrally from the connector.

Furthermore, the self-righting chair allows a seated person to rock back and forth or sideways or in a variety of different directions. This rocking dynamic has a significant positive impact on the health, flexibility and strength of the user when performed over time. The chair may be used in the work place or home to allow an individual habitually seated for long periods of time to alleviate stress-induced muscular pain and muscular skeletal fatigue in the neck, shoulders, and/or spine by rocking back and forth. At the same time, the self-righting chair also encourages constant muscle use in the back and abdominal areas, thus contributing an overall fitness and/or exercise component to the otherwise static practice of sitting. The constant use of the user's muscles also promotes weight loss, as opposed to typical sedentary chairs.

The base member weighs more than the combined connector and seat. The base member further has a substantially uniform distribution of mass throughout the base member, causing it to balance. The bottom surface of the base member also has a uniform curvature throughout; thus, the bottom surface of the base member has an apex that is located at the center of the bottom surface of the base member, causing the base member to balance on its apex.

The connector also has a substantially uniform distribution of mass and extends upwardly along the axis that extends substantially vertically upward through the apex of the base member, causing the base member to balance with the connector extending upwardly in a substantially vertical direction. In one embodiment, the seat has a substantially symmetrical, circular configuration with a substantially uniform distribution of mass and the connector connects to the center of the seat such that a substantially vertical axis extends through: (1) the apex and center of the base member; (2) the connector; and (3) the center of the seat, causing the combination to balance with the (heavier) base member on the bottom.

These features combine to form a convenient self-righting chair. The base member balances on its apex because of its curvature and its substantially uniform distribution of mass. The base member remains balanced with the connector and seat thereon because the connector and seat are positioned along the axis that extends through the apex of the base member substantially vertically upwardly through the connector and seat and because the base member outweighs the connecter and seat.

The self-righting chair of the present invention thus has a variety of different advantages, including convenience of use, decreasing stress, promoting weight loss, and promoting strength gain and overall health and fitness for its users.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which:

FIG. 1 illustrates that the chair can be readily rocked back and forth on during use, conveniently promoting the fitness of the user's musculoskeletal system.

Figures represent views of the chair of FIG. 8 with the seat is shown in a lowered position such that the threads are not shown. FIG. 8A is thus a perspective view of a chair of the present invention, and FIG. 8B is a side view of the chair of FIG. 8A. FIG. 8C is a top view of the chair of FIG. 8A, and FIG. 8D is a bottom view of the chair of FIG. 8A.

FIGS. 12A-14B represent various examples of multi-directional, self-righting chairs of the present invention.

FIG. 12A is a perspective view of a multi-directional, self-righting chair of the present invention.

FIG. 14B is a side view of the chair of FIG. 14A with the seat thereof shown in broken, phantom lines.

DETAILED DESCRIPTION OF THE PREFERRED EMBODIMENTS

Figure 1:
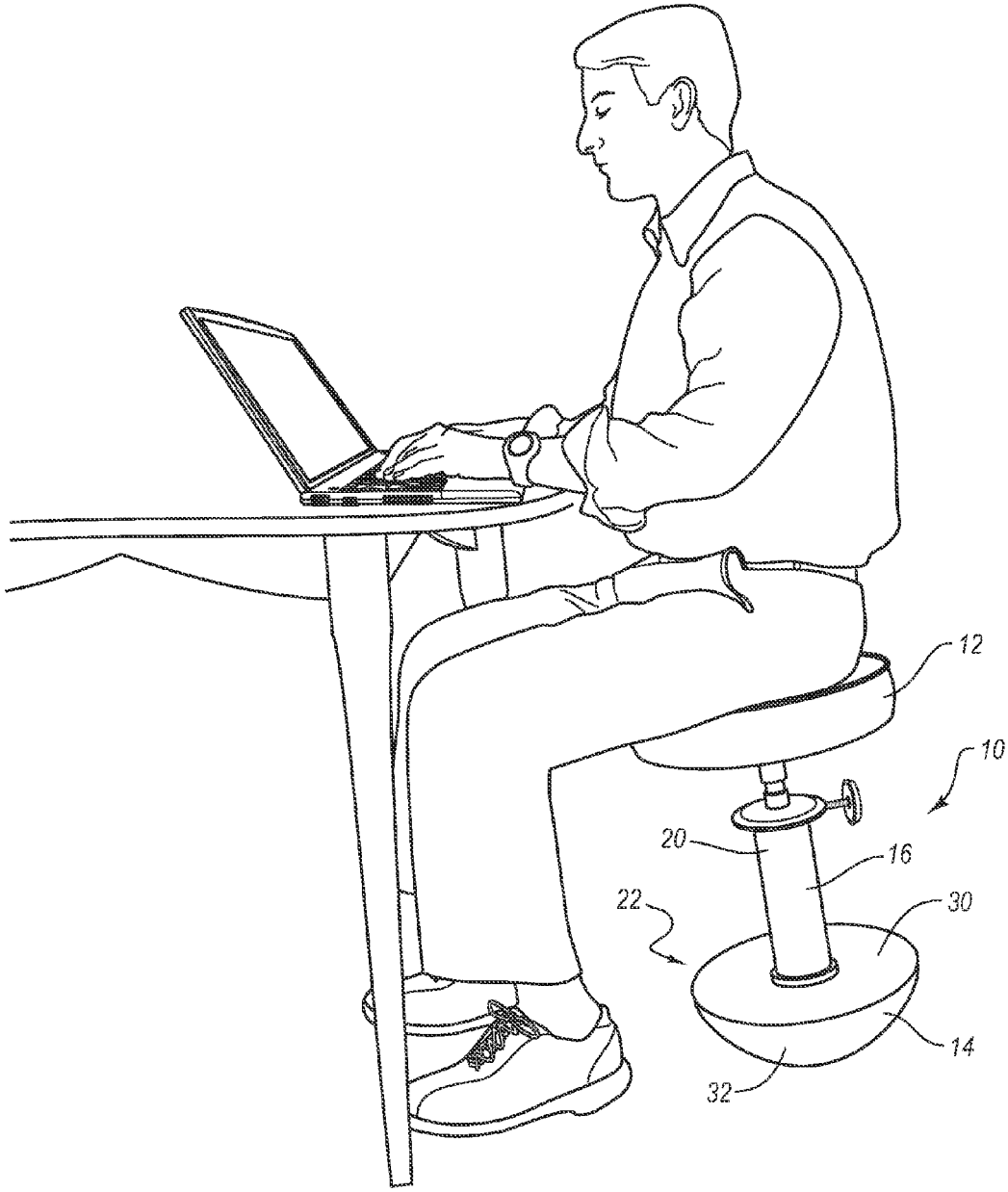
FIG. 1 is a perspective view of an individual seated on a chair of the present invention.

FIG. 1 is a perspective view of an individual seated on a chair 10 of the present invention. Chair 10 can be readily rocked back and forth on during use, conveniently promoting the fitness of the user's musculoskeletal system. As shown in FIG. 1, chair 10 is conveniently used by a user in a home or business setting. The user can rock on chair 10 in a back and forth direction, a side to side direction, and a variety of directions in-between, thereby requiring the user to develop improved balance skills, improved posture, and improved muscular skeletal form and strength, and also promoting weight loss.

Figure 11:
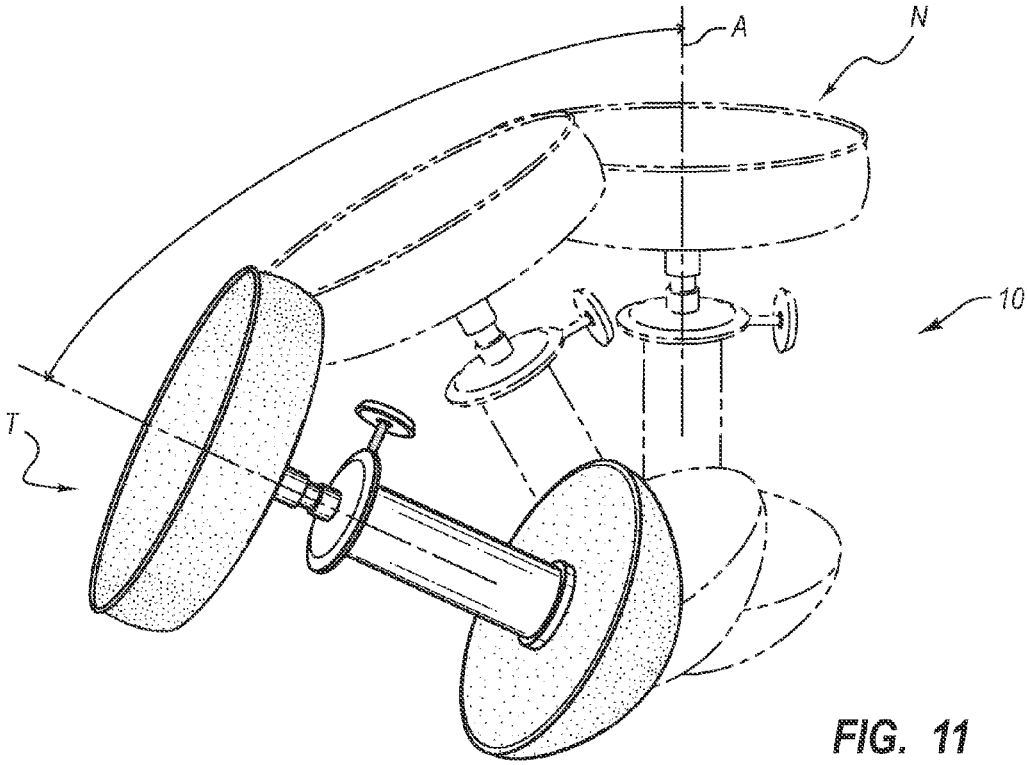
FIG. 11 demonstrates the ability of the chair of FIG. 1 to self-right itself from a tilted position "T" once it has been tilted by a force away from the substantially vertical neutral position "N" illustrated in phantom lines in FIG. 11.
Figure 12A:
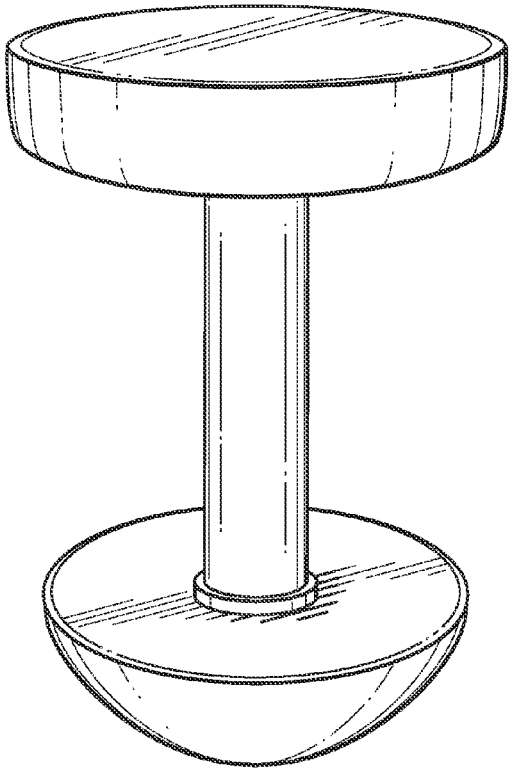
Figure 12C:
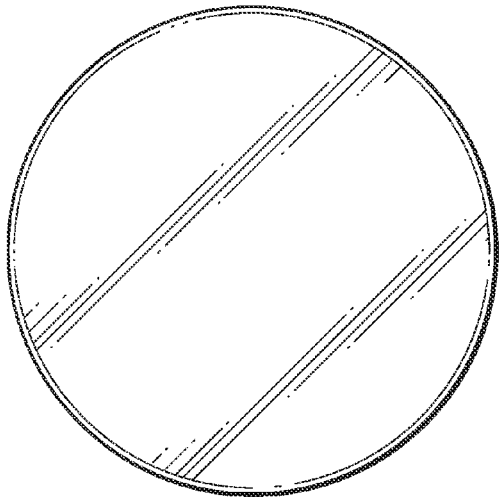
FIG. 12C is a top view of the chair of FIG. 12A.
Figure 12D:
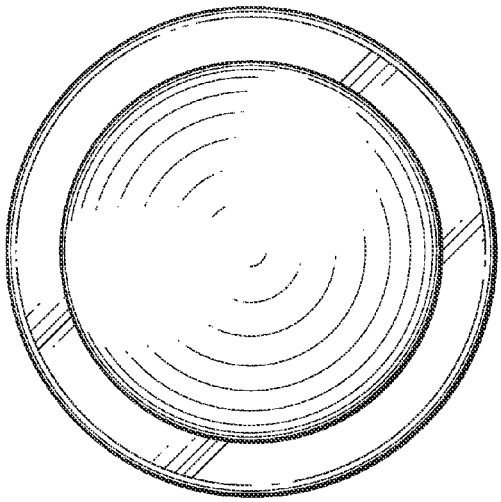
FIG. 12D is a bottom view of the chair of FIG. 12A.
Figure 12B:
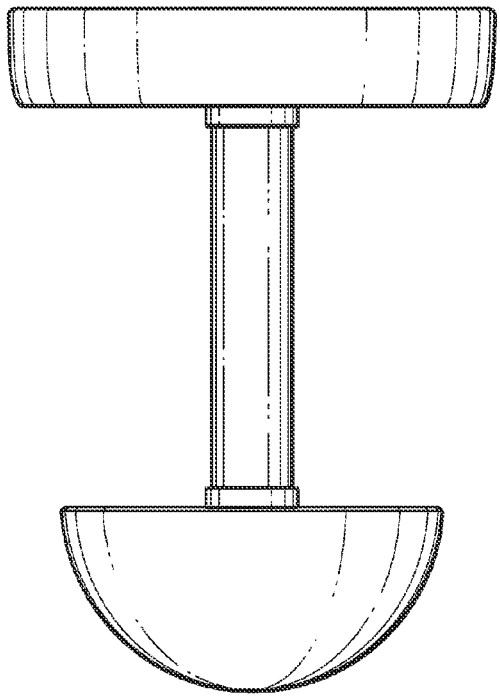
FIG. 12B is a side view of the chair of FIG. 12A.
Figure 13A:
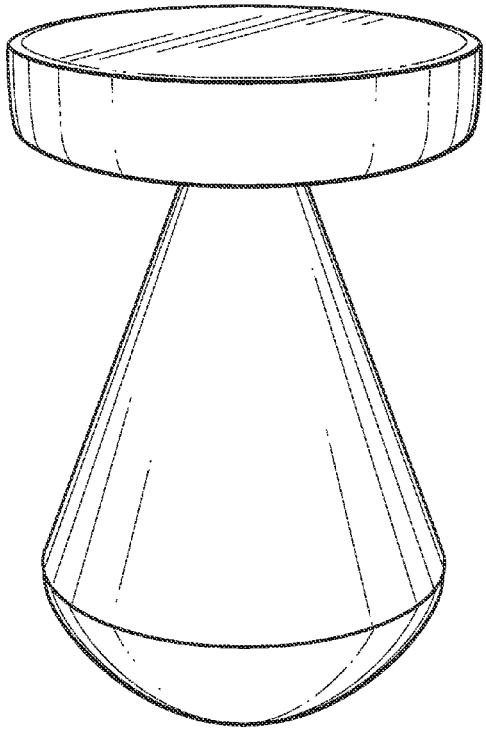
FIG. 13A is a perspective view of a multi-directional, self-righting chair of the present invention.
Figure 13C:
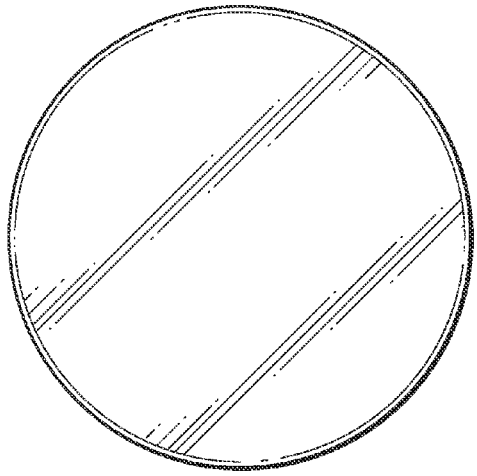
FIG. 13C is a top view of the chair of FIG. 13A.
Figure 13D:
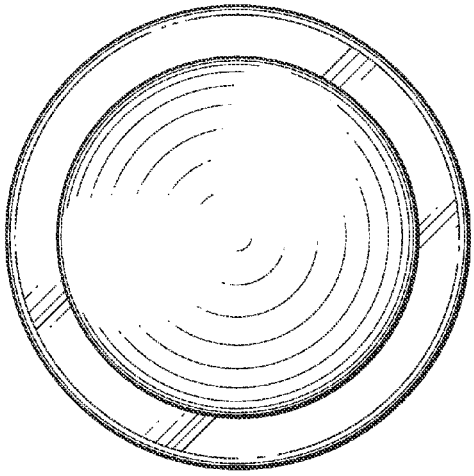
FIG. 13D is a bottom view of the chair of FIG. 13A.
Figure 13B:
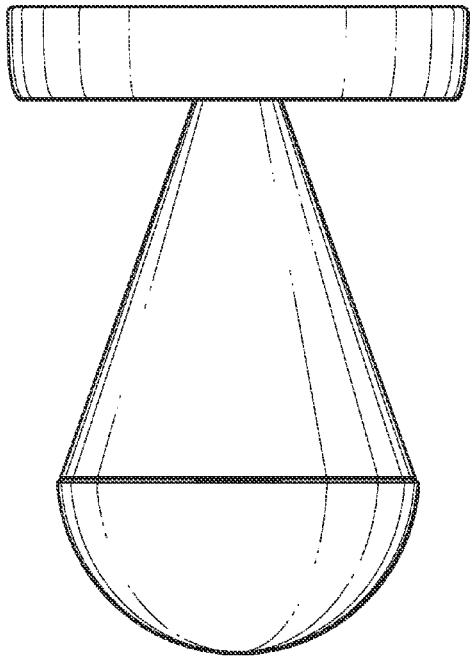
FIG. 13B is a side view of the chair of FIG. 13A.
Figure 14A:
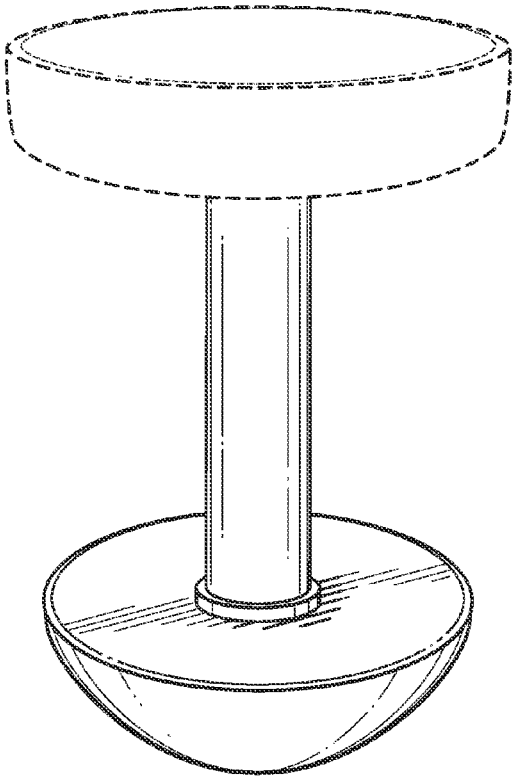
FIG. 14A is a perspective view of a multi-directional, self-righting chair of the present invention with the seat thereof shown in broken, phantom lines.
Figure 14C:
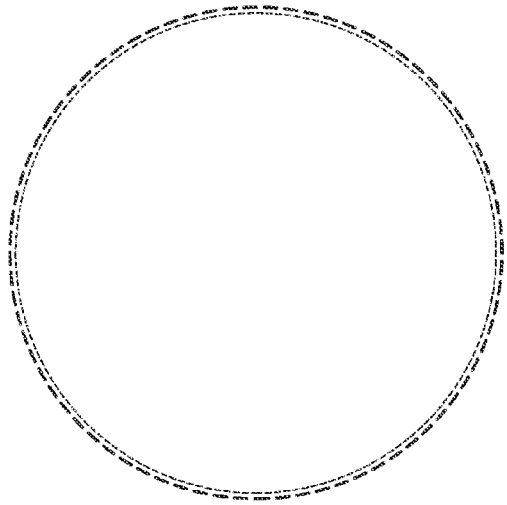
FIG. 14C is a top view of the chair of FIG. 14A, with the seat thereof shown in broken phantom lines.
Figure 14D:
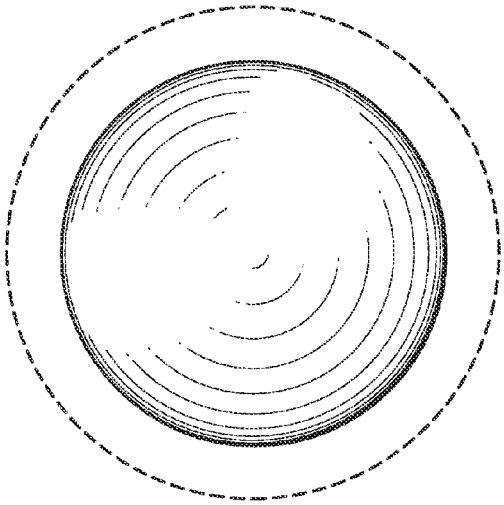
FIG. 14D is a bottom view of the chair of FIG. 14A, with the seat thereof shown in broken phantom lines.
Figure 14B:
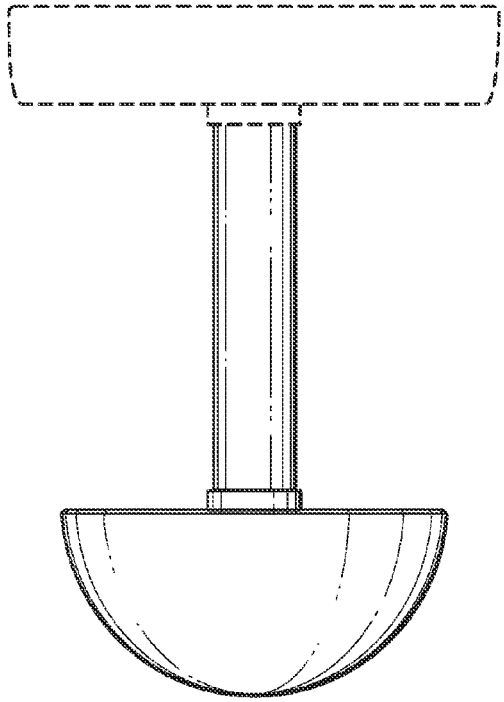

As illustrated in FIGS. 1 and 11, chair 10 is also convenient to use because of the inherent ability of the chair to self-right itself even after it has been moved by a tilting force from a substantially vertical neutral position "N" to a tilted position "T".

Returning to FIG. 1, chair 10 comprises a seat 12, a base member 14 and a connector 16 configured to connect seat 12 to base member 14. As shown in FIG. 1, connector 16 is adjustable. Chair 10 is weighted and designed to be comfortable, convenient to rock back and forth in a variety of different directions, and to be self righting.

In the embodiment of FIG. 1, seat 12 has a substantially circular, substantially symmetrical configuration and has a substantially uniform distribution of mass. Seat 12 has no backrest associated therewith, which has the benefit of requiring the user to use the user's abdominal and back muscles to engage in proper posture. This also induces weight loss in the abdominal and lower back areas, which is often desirable, but difficult to achieve for many individuals. In yet another embodiment, however, a back rest can be used.

Seat 12 can be designed with a variety of different configurations and can be configured to be comfortable by being cushioned or by having a variety of different shapes and designs. Seat 12 can have a rounded or contoured surface and is cushioned for maximum comfort. Seat 12 can be substantially uniformly configured by being configured as shown in FIG. 1, but can also be substantially uniformly configured by having various ergonomically comfortable or form-fitting shapes, as are found in a variety of different seats for chairs, bicycles or other settings in which seats are used. In one embodiment, seat 12 is connected to connector 16 such that it is configured to swivel or twist with respect to the connector 16 and base 14.

Connector 16 is connected substantially to the center of seat 12 and is further connected substantially to the center of base member 14, such that an axis "A" (FIG. 2, 10) extends through seat 12, connector 16 and base 14. As a result, chair 10 is balanced and can be conveniently sat upon in a balanced manner. Also as a result, chair 10 is conveniently self-righting as will be discussed in further detail.

Connector 16 may have a variety of different configurations such as an adjustable configuration as shown in FIG. 1, but also can be configured without height adjustability, as desired by a particular user. Connector 16 has: (i) a lower portion 18 (FIG. 3), which is encapsulated within base member 14, and (ii) a stem 20 connected to lower portion 18. Stem 20, which is not encapsulated within base member 14, extends from lower portion 18 of connector 16 and connects to seat 12. The lower portion 18 of connector 16 and the base member 14 collectively form a base assembly 22. In another embodiment, a base member of the present invention extends integrally from a stem of a connector of the present invention.

Base member 14 has a convex, dome shape, which in the embodiment of FIG. 1 is substantially semi-spherical. In the embodiment of FIG. 1, base member 14 and base assembly 22 have a substantially uniform cross section and a substantially uniform distribution of mass throughout the shape thereof The uniformity of the cross section and curvature of base member 14 and base assembly 22 enables chair 10 be conveniently rocked in a variety of different directions.

Base member 14 is balanced and weighted so as to remain with its apex 34 (FIG. 3) on a support surface and such that its center of gravity causes chair 10 to return to the substantially vertically oriented neutral position "N" (FIG. 11). For example, in one embodiment, at about least sixty percent (60%) of the weight of the overall chair 10 is attributable to the base member 14. When chair 10 is tilted, chair 10 moves from the neutral position "N" to a tilted position "T", then returns to the neutral position "N" when the tilting force is removed.

Since base member 14 outweighs the combination of connector 16 and seat 12, chair 10 is configured to be self-righting. As a result, chair 10 returns to the substantially vertical, neutral position of FIGS. 2 and 3 when a tilting force, such as the sitting force shown in FIG. 1, is removed.

In one embodiment, the weight of base member 14 is at least about fifty percent (50%) greater than the combined weight of connector 16 and seat 12. In yet another embodiment, the weight of base member 14 is at least about one hundred percent (100%) greater than the combined weight of connector 16 and seat 12. In yet another embodiment, the weight of base member 14 is at least about two hundred percent (200%) greater than the combined weight of connector 16 and seat 12. The heavier the weight of base member 14 with respect to connector 16 and seat 12, the more readily the self-righting seat will right itself Thus, in one embodiment, base member 14 may weigh at least about twice as much or at least about three times as much as the combined weight of connector 16 and seat 12 for example.

Furthermore, base member 14 is designed to fit comfortably within a home or office and is sized to provide adequate balance and maneuverability. For example, in one embodiment, the substantially convex dome-shaped base member 14 has a diameter in the range of about 12 inches to about 22 inches. In yet another embodiment, base member 14 has a diameter in the range of about 12 inches to about 20 inches. In yet another embodiment, base member 14 has a diameter in the range of about 12 inches to about 16 inches. In yet another embodiment, base member 14 has a diameter in the range of about 16 inches to about 20 inches.

The overall base assembly 22 resulting from the combination of lower portion 18 of connector 16 and base member 14 thus has a convex, substantially semi-spherical dome shape and a substantially uniform cross section and a substantially uniform distribution of mass, enabling chair 10 to be balanced and conveniently rocked in a variety of different directions, such that when chair 10 is tilted, chair 10 moves from the neutral position "N" to a tilted position "T", then returns to the neutral position "N" when the tilting force is removed.

Furthermore, in one embodiment, the weight of base assembly 22 is at least about fifty percent (50%) greater than the combined weight of connector stem 20 and seat 12. In another embodiment, the weight of base assembly 22 is at least about one hundred percent (100%) greater than the combined weight of connector stem 20 and seat 12. In yet another embodiment, the weight of base assembly 22 is at least about two hundred percent (200%) greater than the combined weight of connector stem 20 and seat 12. Thus, in one embodiment, base assembly 22 may weigh at least about twice as much or at least about three times as much as the combined weight of connector stem 20 and seat 12 for example.

Thus, when a force is placed on chair 10 to move chair 10 from a substantially vertical position, the chair returns from the titled position when the tilting force is released. This makes sitting on the chair convenient, because it always returns to the neutral, substantially vertical position.

As further shown in FIG. 1, a user can comfortably sit on chair 10 and work or engage in recreation or other activities while sitting on chair 10 and while simultaneously improving the user's posture, losing weight and increasing the user's fitness.

Figure 2:
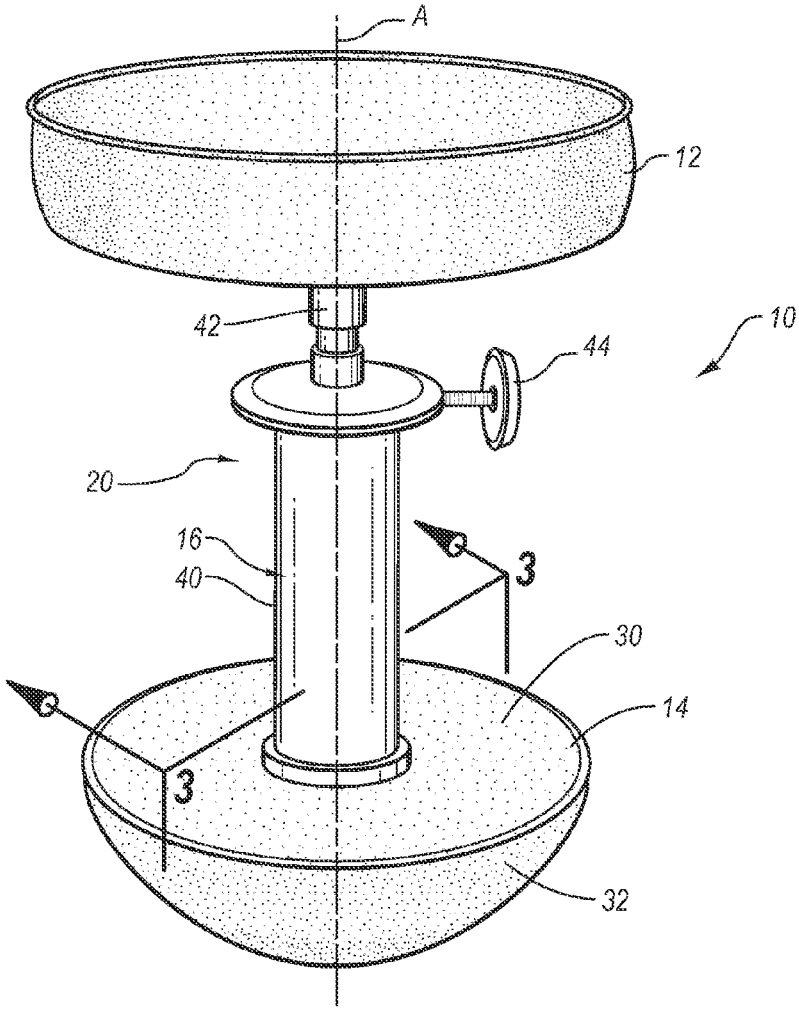
FIG. 2 is a perspective view of the chair shown in FIG. 1. The longitutional axis line "A" illustrates that the seat, connector, and base member are connected along an axis, "A", extended through the substantially central portions of the respective seat, connector and base member to provide a weight balanced chair.

FIG. 2 is a perspective view of the chair 10 shown at FIG. 1. The longitudinal axis line "A" illustrates that seat 12, connector 16, and base member 14 are connected along an axis, "A", extended through the substantially central portions of the respective seat, connector and base member to provide a weight balanced chair 10.

Figure 3:
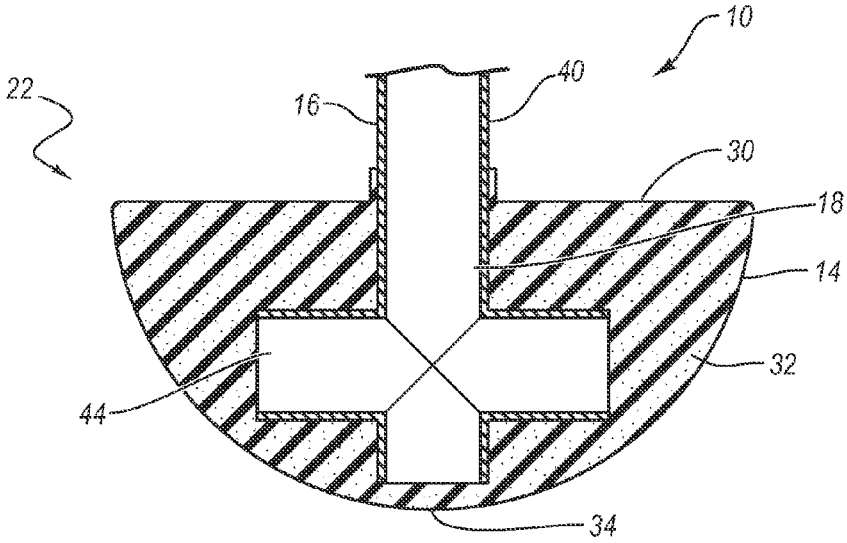
FIG. 3 is a cross sectional view showing a base member encapsulating a lower portion of the connector to form a "base assembly" with the stem of the connector extending upwardly away from the base member, the connector stem being shown in a partially cut-away view. The base member may be formed from an elastomeric material, for example, which in the embodiment of FIG. 3 encapsulates the lower portion of the connector to form the base assembly. The exterior surface of the lower portion of the base member has a uniformly, continuously curved cross section, thereby enabling the user of the chair to conveniently rock back and forth in a variety of directions.

As further shown in FIGS. 2 and 3, connector 16 connects a substantially central portion of base member 14 to a substantially central portion of seat 12. Connector 16 of FIG. 2 has an adjustable height in order to adjust the height of seat 12.

Seat 12 has a substantially circular configuration, having a substantially uniform distribution of mass while base member 14 has a substantially semi-spherical configuration, having a substantially uniform distribution of mass. Bottom surface 32 of base 14 has a convex, dome shaped, curved configuration, such that an apex 34 of base 14 rests on a support surface when chair 10 is not in use or is not being tilted by the tilting force of a user.

Base member 14 balances on its apex 34 because of its curvature and its uniform distribution of mass. Base member 14 remains balanced with connector 16 and seat 12 thereon because connector 16 and seat 12 are positioned along the axis "A" that extends through apex 34 of the base vertically upward through connector 16 and seat 12 and because the bottom portion 32 of base 14 outweighs connector 16, seat 12, and the top portion 30 of base 14.

FIGS. 2 and 3 show that stem 20 of connector 16 has (i) a lower stem member 40 integrally connected to lower portion 18 of connector 16 and (ii) an upper stem member 42 that is connected to seat 12 either by threading into seat 12 or by receiving threads from seat 12 or through some other mechanism e.g. such as mechanisms known in the art, or through some other fashion. Upper member 42 is selectively coupled to lower member 40 through the use of a threaded knob, for example, such that the height of upper member 42 is adjustable with respect to lower member 40. Thus, the two-part connector 16 of FIGS. 2 and 3 is an example of a means for selectively adjusting the height of seat 12.

Lower member 40 of stem 20 of connector 16 connects to lower portion 18, which is located within base member 14. In the embodiment of FIG. 3, lower portion 18 of connector 16 comprises a T-shaped or X-shaped anchor 44 embedded deep in base member 14 to anchor connector 16 within the base member.

In one embodiment, base member 14 comprises a castible material, such as an elastomeric material (e.g., rubber, urethane, polyurethane, plastic or a variety of other castible materials). Employing such a castible material, for example, base member 14 can be formed around the lower portion 18 of connector 16, including the T or X shaped element. Elastomeric materials such as rubber, urethane or polyurethane can provide a high friction contact surface with the ground or floor or other support surface. Elastomeric materials such as or similar to materials used for roller-blade wheels may be useful for base member 14 to provide the desired contact surface. Base member 14 can be cast in a variety of different manners about lower portion 18 such as through injection or insertion molding or through a variety of casting methods known in the art.

Thus, in one embodiment, base member 14 is comprised of a molded material, such as a heavy elastomeric material, resulting from a dome-shaped cast. The dome-shaped material encapsulates the lower portion 18 of connector 16 to form a base assembly 22.

However, a variety of different base assemblies may be employed in the present invention. In one embodiment, for example, a base assembly comprises a base member that is integrally connected to a connector stem, rather than comprising a base member such as member 14 that is encapsulated about a connector lower portion, such as portion 18. The remaining Figures include additional examples of base assemblies of the present invention.

Figure 3A:
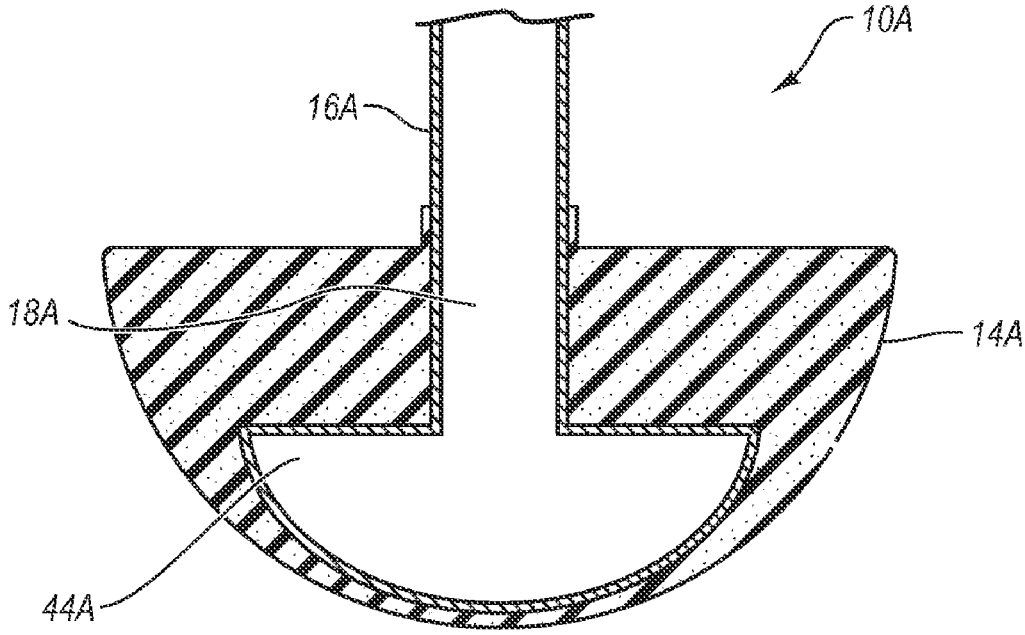
FIG. 3A is an alternative embodiment of a base assembly of the present invention, wherein the lower portion of the connector comprises a dome, mushroom shaped anchor, and wherein the stem of the connector extends upwardly away from the base member and is shown in a partially cutaway view. An elastomeric material, which serves as the base member, encapsulates the dome shaped lower portion of the connector to form a base assembly.

For example, in the embodiment of FIG. 3A, the lower portion 18A of connector 16A comprises a dome, mushroom shaped anchor 44A that has a base member 14A, comprised of an elastomeric material, encapsulated thereabout for use in a chair 10A. Anchor 44A is configured to anchor the connector 16A within base member 14A. Anchors 44 and 44A can served as counterweights in some embodiments.

Alternatively, an anchor of the present invention may have a variety of different shapes or manners that enable material used for the base member to be encapsulated thereabout. In yet another embodiment, as discussed below, the base is comprised of a container in the form of a fillable shell.

Figure 4:
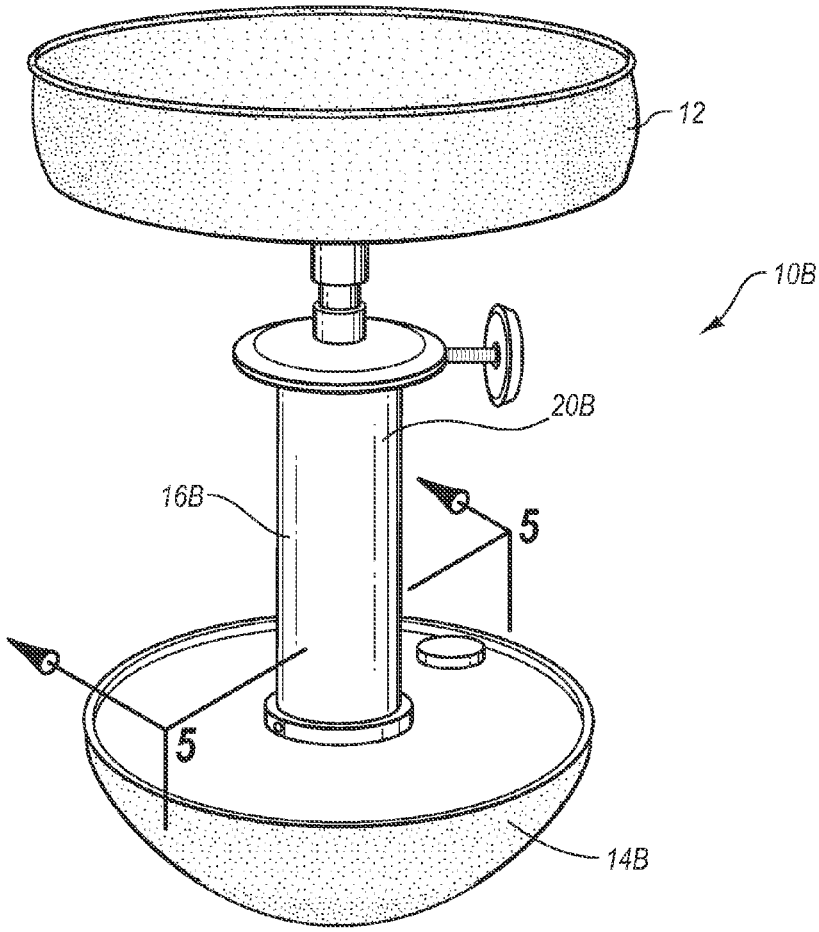
FIG. 4 is an alternative embodiment of the chair of the present invention wherein the base member comprises a hollow container designed with an opening to receive a material therein, such as a pourable filler material, e.g., sand, mineral oil, or water, for example, which can also be removed therefrom for enhancing portability of the chair.

For example, FIG. 4 demonstrates a chair 10B comprising a seat 12, a connector 16B and a base member 14B, having a uniformly curved outer surface, yet having an alternate interior configuration from that of the base member 14 shown in FIGS. 2 and 3.

Figure 5:
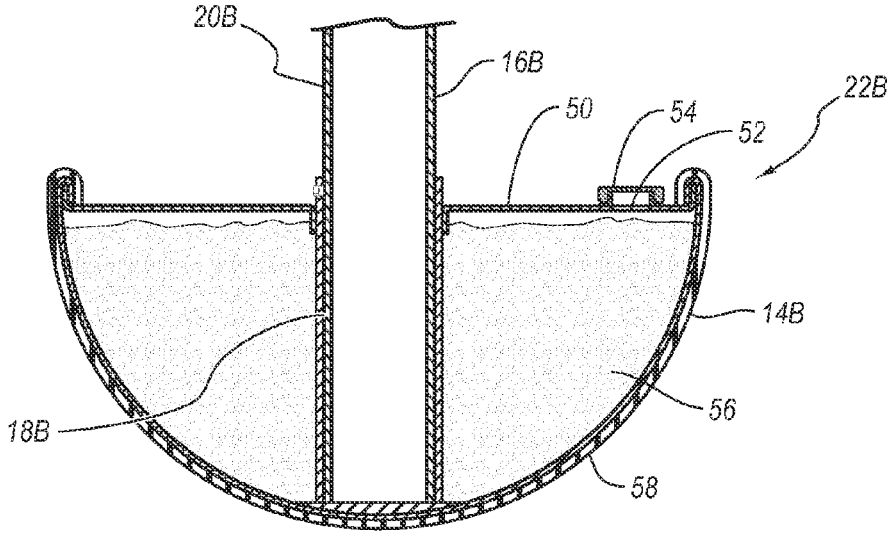
FIG. 5 is a cross-sectional view of the base assembly of the chair of FIG. 4, illustrating a base member in the form of a shell filled with a filler material (e.g., a pourable filler material), such as sand.

In the embodiments of FIGS. 4 and 5, base member 14B comprises a fillable, dome shaped, convex shaped shell 50 that is connected to connector 16B through the use of a set screw. Shell 50 is a hollow container having an opening 52 and a replaceable cap 54 such that a filler material 56 (such as a pourable material, e.g., sand or water) can be selectively placed within hollow dome shaped shell 50. Base member 14B further comprises an elastomeric material 58 (such as rubber, urethane or polyurethane) that encapsulates and coats dome shaped shell 50 to provide a cushioned, high friction contact surface with the ground or floor or other support surface. Shell 50 can be connected to connector 16B through the use of a screw 48, for example.

Base member 14B is conveniently portable because the filler material can be selectively filled into the base member 14*b*, which acts as a convenient container, for use or emptied for convenient transportation. While filled, the filler material provides convenient, substantially uniform distribution of mass. A base member 14B having a hollow portion configured to receive a filler material therein, as shown in FIG. 4, is very useful in light of its convenient, portable nature. Examples of a hollow portion of base member 14B include, but are not limited to: (i) a large empty chamber that can be filled with a large amount of filler, and (ii) a chamber that is already prefilled with some weighting material such that only a smaller empty chamber is available for receiving filler material.

Base member 14B, lower portion 18B of connector 16B, and filler material 56 collectively form another embodiment of a base assembly 22B of the present invention. In one embodiment, the weight ranges indicated above with respect to the base member 14 and/or base assembly 22 apply to the base assembly 22B shown in FIGS. 4 and 5. Thus, in one embodiment, the weight of base assembly 22B is at least about fifty percent (50%) greater than the combined weight of connector stem 20B and seat 12. In another embodiment, the weight of base assembly 22B is at least about one hundred percent (100%) greater than the combined weight of connector stem 20B and seat 12. In yet another embodiment, the weight of base assembly 22B is at least about two hundred percent (200%) greater than the combined weight of connector stem 20B and seat 12. Thus, in one embodiment, base assembly 22B (which comprises base member 14B, lower portion 18B, and filler material 56) may weigh at least about twice as much or at least about three times as much as the combined weight of: (i) connector stem 20B of connector 16B; and (ii) seat 12, for example.

Figure 6:
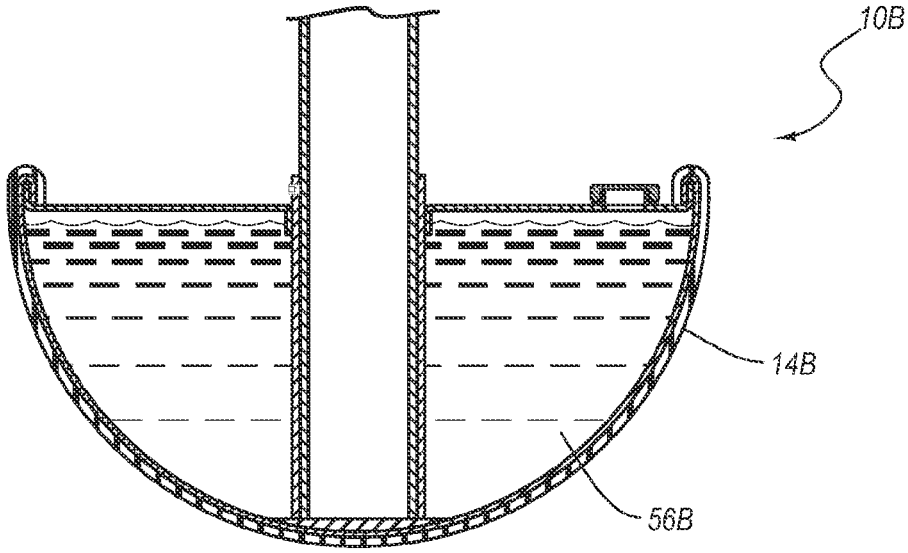
FIG. 6 is an alternative view of the base assembly of the chair of FIG. 4 wherein the filler material is a liquid, such as mineral oil, for example (or, in another embodiment, water or another pourable material).

FIG. 6 demonstrates the use of base 14B of the present invention being used with an alternate filler material 56B such as mineral oil, water or another fluid.

Figure 7:
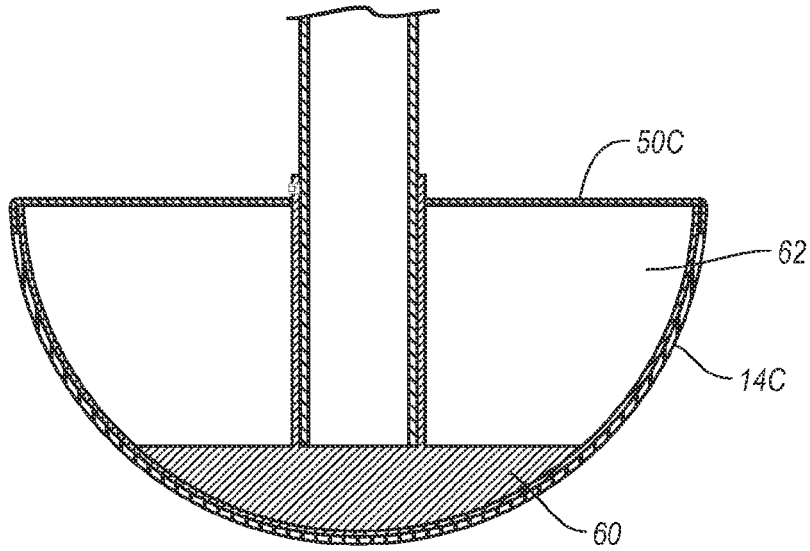
FIG. 7 is a view of an alternative embodiment of a base assembly of a chair of the present invention wherein a heavy dome shaped member (e.g., a metallic material such as iron) is connected (e.g., through welding) to a dome shaped shell (which may also comprise a metallic material, for example).

FIG. 7 demonstrates another base 14C of the present invention comprising a shell 50C having a heavy member 60 (e.g., a member comprised of iron or another metallic material or another heavy material) connected thereto with the remainder of the shell being hollow as shown at hollow portion 62. In one embodiment, the shell is a metallic material that is welded to the member 60.

Figure 8:
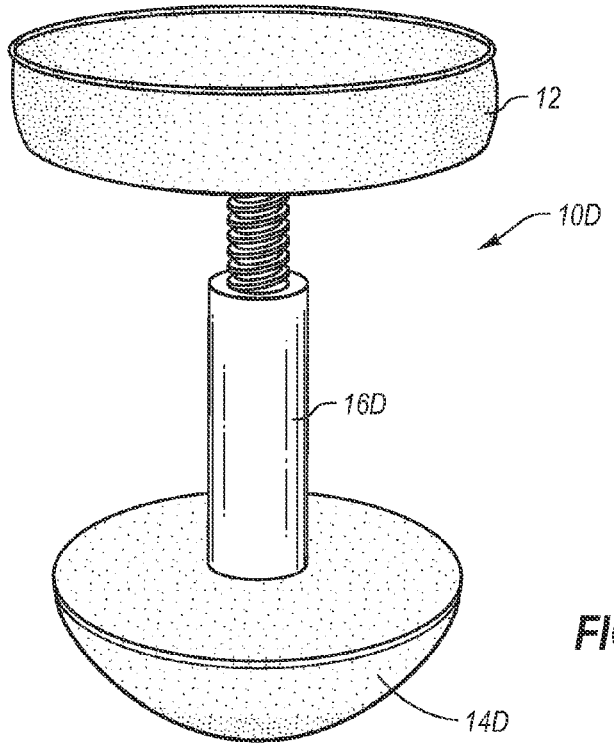
FIG. 8 is a view of an alternative chair of the present invention wherein a screw-driven main shaft is used to selectively raise and lower the height of the seat.

FIG. 8 demonstrates a chair 10D of the present invention, comprising a seat 12, a connector 16D and a base member 14D, wherein the connector has a screw-type height adjustor, which is another example of a means for selectively adjusting the height of seat.

Figure 9:
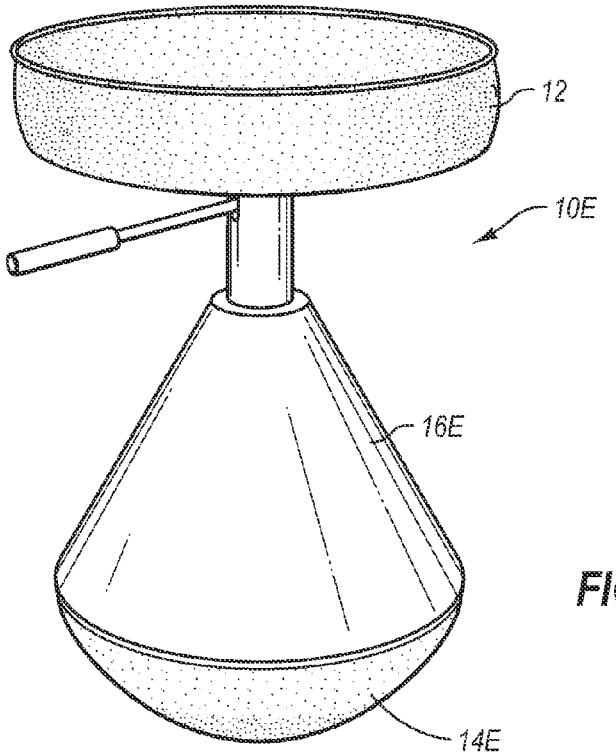
FIG. 9 demonstrates a chair of the present invention wherein the stem of the connector has a conical shape and wherein the height of the seat is adjustable, e.g., through a pneumatic mechanism.

FIG. 9 demonstrates a chair 10E of the present invention having a seat 12, a connector 16E and a base member 14E, wherein the connector has a conical configuration and/or a conical cosmetic cover disposed around an internal connector mechanism. FIG. 9 demonstrates that a pneumatic or gas shock mechanism may be used to adjust the seat 12 of FIG. 9, thus demonstrating additional examples of means for selectively adjusting the height of seat 12.

Figure 10:
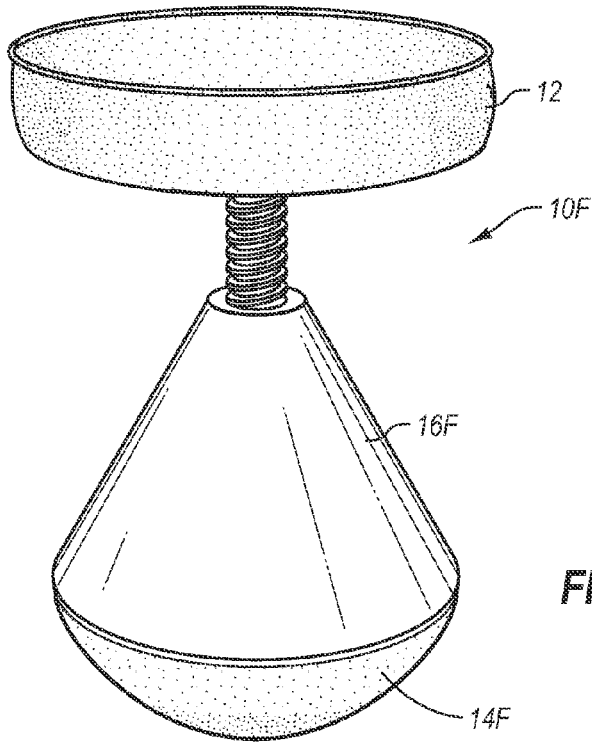
FIG. 10 demonstrates a chair of the present invention wherein the stem of the connector has a conical shape and wherein a threaded screw is used to adjustably position the seat height.

FIG. 10 demonstrates a chair 10F of the present invention having a seat 12, a height adjustable connector 16F having a conical configuration, and a base 14F. The conical member may be a cosmetic member disposed about a connector mechanism, for example.

FIG. 11 demonstrates chair 10 of the present invention with the axis "A" extending through the seat, connector, and base thereof and showing movement of chair 10 from a tilted position "T" and returning to the substantially vertical, neutral position "N" (shown in phantom lines) when the tilting force causing the tilt has been removed.

A variety of different connectors can be used in the present invention. For example, the connector may have various shapes and sizes, including, but not limited to, a straight post, a straight threaded, two-piece post, conical threaded two piece, cylindrical threaded two-piece, or a variety of different shapes that are designed to connect a seat to a base.

The threaded, two-piece construction and other constructions allow for adjustable seat heights in relating to the ground for all body sizes, although a variety of different constructions are available for adjusted seat heights. These mechanisms are examples of means for selectively adjusting the height of the seat of the present invention, e.g., seat 12. In one embodiment, such means for selectively adjusting the height of the seat includes the connector 16, wherein connector 16 comprises at least two posts 40, 42 that are movably connected. Other embodiments of such means for selectively adjusting the height of the seat include a connector such as connector 16D that is threadedly connected to seat 12, a pneumatic or gas shock mechanism, as shown in FIG. 9, and a variety of other mechanisms configured to selectively adjusting the height of the seat of the present invention.

The chair 10 of the present invention is a unique seating device, of simple and low cost design, that promotes in an individual both movement and flexibility and thus a healthy lifestyle sitting. The chair is such as to allow the invention to be manufactured and assembled as a sturdy unit by relatively simply and inexpensive means.

The chair 10 of the present invention addresses the need for an office or home sitting solution that encourages good posture and constant stretching of the muscular skeletal features e.g. spine, torso, and hips. Individuals who slouch or sit in static positions for long periods of time often experience back discomfort with temporary or chronic pain. Recent studies also suggest that even small amounts of physical activity (e.g. rocking), can help control an individual's weight by burning extra calories throughout the day. The self-righting chair 10 of the present invention also encourages constant muscle use in the back and abdominal areas, thus adding an overall fitness or exercise component to the otherwise static practice of sitting.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A self-righting chair having a substantially vertical neutral position, the chair being configured to maintain the substantially vertical neutral position in the absence of a tilting force, the chair comprising:

a seat;

a base member; and a connector connecting the seat to the base member such that the seat is located above the base member when the chair is in the substantially vertical, neutral position;

wherein the base member has a semi-spherical, curved configuration culminating in an apex, wherein the weight of the base member is at least about one hundred percent greater than the combined weight of the connector and the seat, wherein the connector connects a substantially central portion of the seat to a substantially central portion of the base member, such that the seat, connector, and base member are connected along an axis extending through the substantially central portions of the respective seat, connector and base member to provide a weight balanced chair, such that when a force is exerted to move the chair from the substantially vertical neutral position to a tilted position, the chair is moved from the substantially vertical neutral position to the tilted position, then returns to the substantially vertical neutral position when the tilting force is removed, wherein the chair always returns from any amount of tilt to the substantially vertical position and wherein the diameter of the seat is greater than the diameter of the base.

2. The self righting chair of claim 1, wherein the base member has a substantially uniform distribution of mass.

3. The self righting chair of claim 2, wherein the weight of the base member is at least one hundred percent greater than the combined weight of the connector and seat.

4. The chair of claim 2 wherein the seat is a substantially symmetrical seat having a substantially uniform distribution of mass.

5. The self-righting chair of claim 1, wherein the base member has a diameter in the range of about 12 inches to about 20 inches.

6. The self-righting chair of claim 1, wherein the base member includes a high friction material to prevent the base member from slipping on a support surface.

7. The self-righting chair of claim 6, wherein the high friction material comprises an elastomeric material.

8. The self-righting chair of claim 1, wherein the weight of the base member is at least about two hundred percent greater than the combined weight of the connector and seat.

9. The self-righting chair of claim 1, wherein the base member comprises a hollow container, and further comprising a filler material configured to be placed in the hollow container.

10. The self-righting chair of claim 1, wherein the base member has a dome-shaped configuration.

11. A self-righting chair configured to allow a user to sit thereon while resting the user's feet upon a floor surface and rock back and forth to promote the fitness of the user's musculoskeletal system, comprising:

a seat configured to allow a user to sit thereon while resting the user's feet upon a floor surface;

an elongate connector; and a substantially convex dome-shaped, substantially semi-spherical base member having a bottom surface, the base member further having (i) a substantially uniform curvature along the entire bottom surface thereof and (ii) a substantially uniform distribution of mass, wherein the elongate connector connects a substantially central portion of the seat to a substantially central portion of the base member, wherein the seat, connector, and base member are connected along an axis extending through the substantially central portions of the respective seat, connector and base member to provide a weight balanced chair, and wherein the substantially uniform curvature and distribution of the mass of the base member enable the chair to be tilted in any direction and further cause the chair to return to a substantially vertical position when a tilting force is removed, the seat being located above the base member when the chair is in the substantially vertical position, wherein the diameter of the seat is greater than the diameter of the base, and wherein the weight of the base member is at least about one hundred percent greater than the combined weight of the elongate connector and the seat.

12. The self-righting chair of claim 11, wherein the seat is configured to swivel with respect to the connector.

13. The self-righting chair of claim 11, wherein the base member is configured to balance on an apex thereof.

14. The self-righting chair of claim 11, further comprising means for selectively adjusting the height of the seat.

15. The self-righting chair of claim 11, wherein the base member encapsulates a portion of the connector.

16. A self-righting chair, comprising:

a substantially symmetrical seat having a substantially uniform distribution of mass;

a connector having a lower portion and a stem, the stem of the connector being coupled to the seat; and a substantially semi-spherical shaped base member having the lower portion of the connector connected thereto to form a base assembly, the connector connecting a substantially central portion of the seat to a substantially central portion of the base assembly, the base assembly having a substantially uniform distribution of mass, wherein the seat is located above the base member when the chair is in a substantially vertical position, wherein the weight of the base assembly is at least about one hundred percent greater than the combined weight of the stem of the connector and the seat, the lower surface of the base member having curvature, wherein the seat, connector, and base member are connected along an axis extending through the substantially central portions of the respective seat, connector and base member to provide a weight balanced chair, such that when a tilting force moves the chair from a substantially vertical neutral position to a tilted position, the chair returns to the substantially vertical neutral position when the tilting force is removed due to the weight of the base assembly, and wherein the diameter of the seat is greater than the diameter of the base.

17. The self-righting chair of claim 16, wherein the base assembly comprises a hollow container and a filler material configured to be placed in the hollow container of the base assembly.

18. The self-righting chair of claim 16, wherein the connector is configured to adjust the height of the seat to accommodate a height of a user.

19. The self-righting chair of claim 16, wherein the weight of the base assembly is at least one hundred percent greater than the combined weight of the connector stem and seat.

20. The self-righting chair of claim 16, wherein the weight of the base assembly is at least about two hundred percent greater than the combined weight of the connector stem and seat.

21. The self-righting chair of claim 16, wherein the base member has a diameter in the range of about 12 inches to about 22 inches.

22. A self-righting chair, comprising:

a substantially symmetrical seat having a substantially uniform distribution of mass;

a connector having a lower portion and a stem, the stem of the connector being coupled to the seat; and a substantially semi-spherical shaped base member having the lower portion of the connector coupled thereto to form a base assembly, wherein the seat is located above the base member when the chair is in a substantially vertical position such that a central portion of the seat is located above a central portion of the base assembly when the chair is in the substantially vertical position, the connector connecting a substantially central portion of the seat to a substantially central portion of the base member, the base assembly having a substantially uniform distribution of mass, wherein the weight of the base assembly is at least about one hundred percent greater than the combined weight of the stem of the connector and the seat, the lower surface of the base member having a curvature, and wherein the seat, connector, and base member are connected along an axis extended through the substantially central portions of the respective seat, connector and base member to provide a weight balanced chair, such that when a tilting force moves the chair from a substantially vertical neutral position to a tilted position, the chair returns to the substantially vertical neutral position when the tilting force is removed and wherein the diameter of the seat is greater than the diameter of the base assembly.

23. A self-righting chair as recited in claim 22, further comprising a filler material disposed within the base member, wherein the combined weight of the base member and filler material is greater than the combined weight of the connector and the seat.

24. A self-righting chair as recited in claim 22, wherein the lower portion of the connector comprises an anchor configured to anchor the connector within the base member.

* * * * *